US010882679B2

(12) United States Patent
Ikeda

(10) Patent No.: US 10,882,679 B2
(45) Date of Patent: Jan. 5, 2021

(54) CUSHION STRUCTURE

(71) Applicant: KYOCERA Document Solutions Inc., Osaka (JP)

(72) Inventor: Masami Ikeda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/414,559

(22) Filed: May 16, 2019

(65) Prior Publication Data

US 2019/0352073 A1 Nov. 21, 2019

(30) Foreign Application Priority Data

May 17, 2018 (JP) ..... 2018-095494

(51) Int. Cl.

| | |
|---|---|
| ***B65D 81/05*** | (2006.01) |
| ***B65D 81/113*** | (2006.01) |
| ***B65D 81/133*** | (2006.01) |
| ***G03G 21/16*** | (2006.01) |

(52) U.S. Cl.

CPC ..... *B65D 81/113* (2013.01); *B65D 81/133* (2013.01); *G03G 21/16* (2013.01); *B65D 2585/6897* (2013.01)

(58) Field of Classification Search

CPC ..... B65D 81/113; B65D 81/133; B65D 2585/689; B65D 81/05; B65D 25/10; B65D 25/108; B65D 2585/6892

USPC ..... 206/488, 486, 583, 592

See application file for complete search history.

(56) References Cited

U.S. PATENT DOCUMENTS

| | | | | |
|---|---|---|---|---|
| 7,992,715 | B2 * | 8/2011 | Kwon | G03G 15/08 206/320 |
| 8,186,512 | B2 * | 5/2012 | Bertken | B65B 15/00 206/461 |
| 2006/0086635 | A1 * | 4/2006 | Kari | B65D 5/5052 206/485 |
| 2007/0187283 | A1 * | 8/2007 | Otsuka | B65D 81/113 206/576 |
| 2012/0097569 | A1 * | 4/2012 | Murano | B65D 77/04 206/523 |
| 2014/0305838 | A1 * | 10/2014 | Kawata | B65D 77/0433 206/784 |

FOREIGN PATENT DOCUMENTS

JP 2014102402 A 6/2014

* cited by examiner

*Primary Examiner* — Steven A. Reynolds
(74) *Attorney, Agent, or Firm* — Studebaker & Brackett PC

(57) ABSTRACT

A cushion structure is accommodated in packing together with an image forming apparatus and a waste toner box. The cushion structure includes a cushioning member. The cushioning member surrounds the waste toner box and restricts a position of the waste toner box. A cushion structure is accommodated in a packing case together with a package item including a main apparatus and an accessory. The cushion structure includes cushioning members. The cushioning members cushion shock on the package item. The cushioning members include a planar main body and a restriction section. The planar main body is disposed on a top surface of the main apparatus. The restriction section is an opening in the main body. The restriction section restricts movement of the accessory supported on the top surface of the main apparatus by inserting the accessory into the opening.

4 Claims, 8 Drawing Sheets

CUSHION STRUCTURE

INCORPORATION BY REFERENCE

The present application claims priority under 35 U.S.C. § 119 to Japanese Patent Application No. 2018-095494, filed on May 17, 2018. The contents of this application are incorporated herein by reference in their entirety.

BACKGROUND

The present disclosure relates to a cushion structure.

An image forming apparatus forms an image on a medium such as paper. The image forming apparatus is suitably used as a copier, a facsimile machine, a printer, or a multifunction peripheral. The image forming apparatus is kept with a cushioning member inside packing during transportation or storage. The cushioning member cushions shock on the image forming apparatus even when the packing is impacted.

For example, a known package includes a packaging box, a restraining member, and an image forming apparatus and a developer cartridge that are packed in the packaging box and restrained by the restraining member. The packaging box of such a package has a recess for accommodating the developer cartridge. The developer cartridge in a wrapping bag is inserted in the recess and the restraining member is placed over the recess. The restraining member can cushion shock on the developer cartridge and prevent toner leakage from the developer cartridge even when the package is turned upside down.

SUMMARY

A cushion structure according to an aspect of the present disclosure is accommodated in packing together with an image forming apparatus and a waste toner box. The cushion structure includes a cushioning member. The cushioning member surrounds the waste toner box and restricts a position of the waste toner box.

A cushion structure according to another aspect of the present disclosure is accommodated in a packing case together with a package item including a main apparatus and an accessory. The cushion structure includes cushioning members. The cushioning members cushion shock on the package item. The cushioning members include a planar main body and a restriction section. The planar main body is disposed on a top surface of the main apparatus. The restriction section is an opening in the main body. The restriction section restricts movement of the accessory supported on the top surface of the main apparatus by inserting the accessory into the opening.

DETAILED DESCRIPTION

Figure 1:
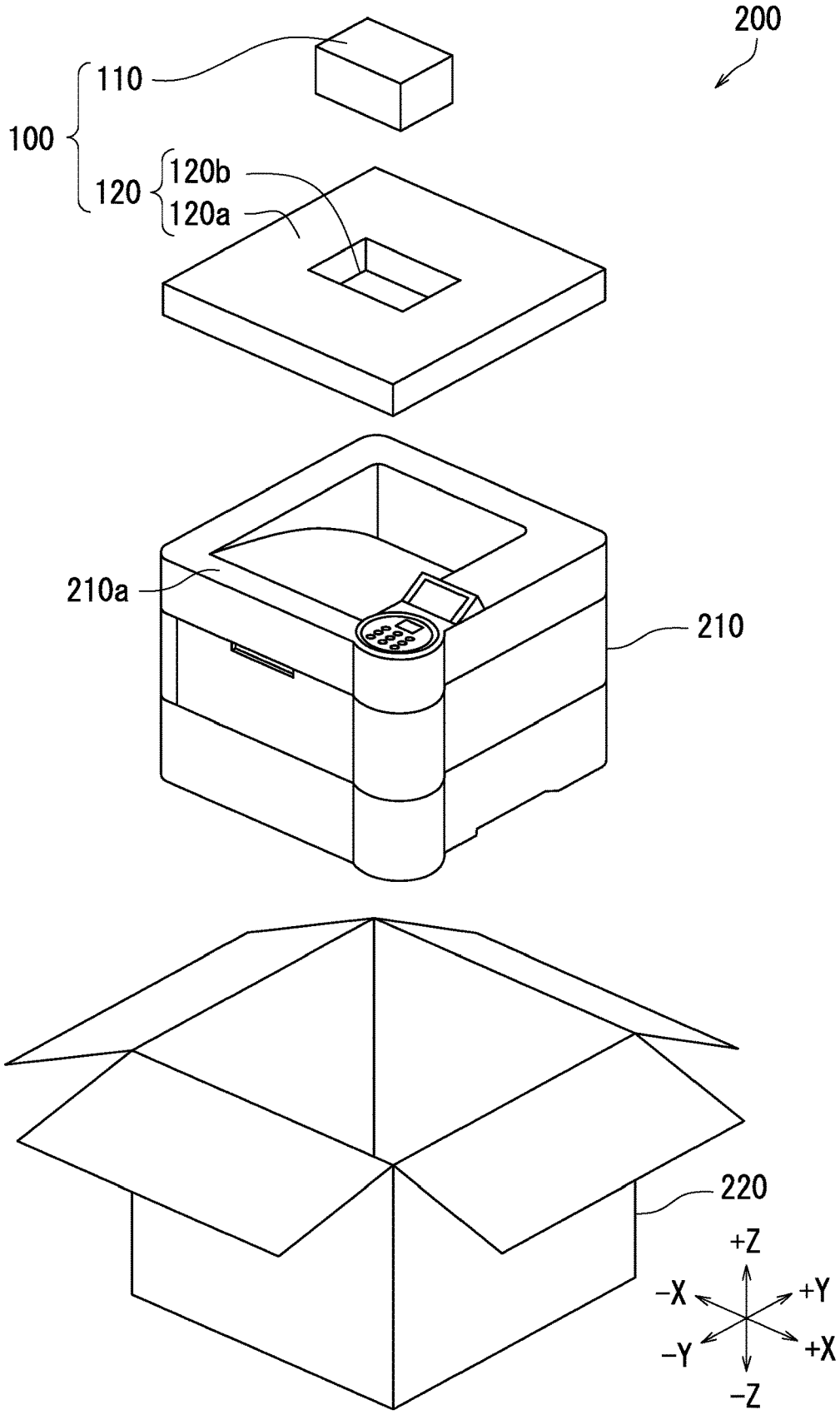
FIG. 1 is an exploded perspective view of a package including a cushion structure according to an embodiment of the present disclosure.

The following describes an embodiment of a cushion structure according to the present disclosure with reference to the accompanying drawings. Note that elements that are the same or equivalent are marked by the same reference signs in the drawings and description thereof is not repeated. The present specification may use X, Y, and Z directions, which are orthogonal to one another, to facilitate understanding of the disclosure. The X and Y directions are parallel to a horizontal direction, and the Z direction is parallel to a vertical direction.

The following describes a cushion structure 100 according to the embodiment of the present disclosure with reference to FIG. 1. FIG. 1 is an exploded perspective view of a package 200 including the cushion structure 100.

The package 200 includes the cushion structure 100, an image forming apparatus 210, and packing 220. The packing 220 has a hollow box shape. The packing 220 has a substantially rectangular parallelepiped outer shape. The packing 220 accommodates the cushion structure 100 and the image forming apparatus 210. The image forming apparatus 210 is packed in the packing 220. Note that the image forming apparatus 210 is an example of what may be referred to as a "main apparatus". The image forming apparatus 210 is a copier, a facsimile machine, a printer, or a multifunction peripheral.

The cushion structure 100 is packed in the packing 220 as well as the image forming apparatus 210. The cushion structure 100 in the present example is placed above the image forming apparatus 210. The cushion structure 100 is supported on a top surface of the image forming apparatus 210. The cushion structure 100 cushions shock on the image forming apparatus 210 even when the package 200 is impacted.

The cushion structure 100 includes a waste toner box 110 and a cushioning member 120. The waste toner box 110 is attached to the image forming apparatus 210 for use. Note that the image forming apparatus 210 may be accommodated in packing 220 together with the waste toner box 110.

The waste toner box 110 is made of a material that is softer than a material of a housing of the image forming apparatus 210. The waste toner box 110 is elastic. The waste toner box 110 therefore slightly deforms upon application of force by a human hand but returns to the original shape upon removal of the force. For example, the waste toner box 110 is made of polypropylene (PP). Alternatively, the waste toner box 110 may be made of polyethylene (PE). Note that the waste toner box 110 is an example of what may be referred to as an "accessory".

The cushioning member 120 surrounds the waste toner box 110 and restricts the position of the waste toner box 110. The cushioning member 120 is made of a material that is softer than the material of the housing of the image forming apparatus 210. For example, the cushioning member 120 is made of cardboard. Alternatively, the cushioning member 120 may be made of foamed plastic. For example, the cushioning member 120 is made of foamed polystyrene.

The cushioning member 120 may be formed from a material that is softer than the material of the waste toner box 110. Alternatively, the waste toner box 110 may be formed from a material that is softer than the material of the cushioning member 120.

The cushioning member 120 has a planar main body 120*a* and a restriction section 120*b*. The restriction section 120*b* is an opening located approximately in the center of the main body 120*a*.

The waste toner box 110 is disposed in the restriction section 120*b*, and the restriction section 120*b* restricts the position of the waste toner box 110. The waste toner box 110 is disposed in a space defined by the restriction section 120*b*. The restriction section 120*b* is recessed in a thickness direction (Z direction) relative to a top surface of the main body 120*a*. A thickness (Z-direction length) of the restriction section 120*b* is smaller than a thickness (Z-direction length) of the main body 120*a*. That is, the restriction section 120*b* restricts movement of the waste toner box 110 supported on the top surface of the image forming apparatus 210 by inserting the waste toner box 110 into the opening.

The restriction section 120*b* may be a through hole formed in the cushioning member 120, and the waste toner box 110 may be disposed in the through hole. In such a configuration, the waste toner box 110 is supported on a supporting surface 210*a* that supports the cushioning member 120. The supporting surface 210*a* is the top surface of the image forming apparatus 210. Alternatively, the restriction section 120*b* may be a depression, and the waste toner box 110 may be disposed on a bottom surface of the depression defining the restriction section 120*b*.

The restriction section 120*b* has a shape corresponding to a shape of the waste toner box 110. For example, the restriction section 120*b* has a length and a width that are substantially equal to or longer than a length and a width, respectively, of the waste toner box 110. When the waste toner box 110 is in the restriction section 120*b* of the cushioning member 120, the main body 120*a* of the cushioning member 120 surrounds the waste toner box 110, and thus the cushioning member 120 restricts horizontal movement of the waste toner box 110.

The cushioning member 120 may fix the waste toner box 110. For example, an X-direction length of the restriction section 120*b* of the cushioning member 120 may be substantially equal to an X-direction length of the waste toner box 110, and a Y-direction length of the restriction section 120*b* of the cushioning member 120 may be substantially equal to a Y-direction length of the waste toner box 110. In such a configuration, the waste toner box 110 is fixed by being press fitted into the cushioning member 120.

Alternatively, the X-direction length and the Y-direction length of the restriction section 120*b* of the cushioning member 120 may be slightly longer than the X-direction length and the Y-direction length, respectively, of the waste toner box 110, and the waste toner box 110 may be fixed to the cushioning member 120 using for example adhesive tape. Alternatively, the waste toner box 110 is not fixed to the cushioning member 120.

Note that an item other than the waste toner box 110 may be packed in the packing 220. For example, documents such as an instruction manual and a warranty of the image forming apparatus may be packed between any of inner surfaces of the packing 220 and the image forming apparatus 210.

Figure 2:
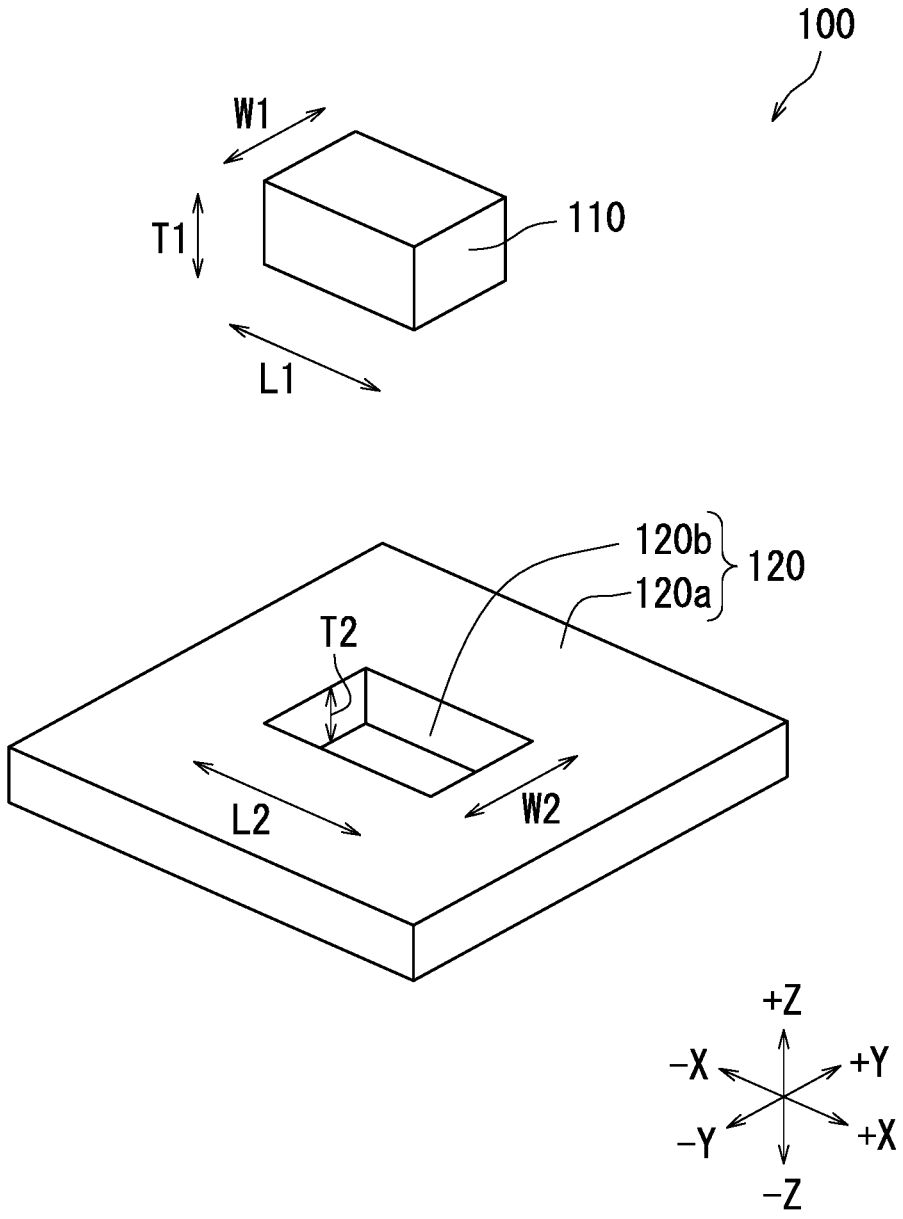
FIG. 2 is an exploded perspective view of the cushion structure according to the embodiment.

FIG. 2 is an exploded perspective view of the cushion structure 100 according to the present embodiment. The waste toner box 110 is disposed in the restriction section 120*b* of the cushioning member 120.

A longitudinal direction of the waste toner box 110 is parallel to the X direction. That is, an X-direction length L1 of the waste toner box 110 is longer than a Y-direction length W1 of the waste toner box 110. Furthermore, a Z-direction length T1 of the waste toner box 110 is shorter than the Y-direction length W1 of the waste toner box 110.

The outline of an edge of the opening serving as the restriction section 120*b* has substantially the same shape as the outer shape of the waste toner box 110. An X-direction length L2 of the restriction section 120*b* is longer than a Y-direction length W2 of the restriction section 120*b*. A Z-direction length T2 of the restriction section 120*b* is shorter than a Y-direction length W2 of the restriction section 120*b*.

A thickness T2 of inner surfaces defining the opening serving as the restriction section 120*b* is slightly longer than a thickness T1 of the waste toner box 110. The length L2 and the length W2 of the restriction section 120*b* are respectively longer than the length L1 and the length W2 of the waste toner box 110.

For example, a difference between the length L2 of the restriction section 120*b* and the length L1 of the waste toner box 110 is from 1 mm to 50 mm. Preferably, the difference between the length L2 and the length L1 is from 3 mm to 30 mm. A difference between the length W2 of the restriction section 120*b* and the length W1 of the waste toner box 110 is from 1 mm to 50 mm. Preferably, the difference between the length W2 and the length W1 is from 3 mm to 30 mm.

The cushioning member 120 in the present example has a substantially rectangular parallelepiped outer shape, and outer surfaces of the cushioning member 120 are substantially flat. The cushioning member 120 has a through hole in the center thereof, and sides defining the through hole form the restriction section 120*b*.

Figure 3:
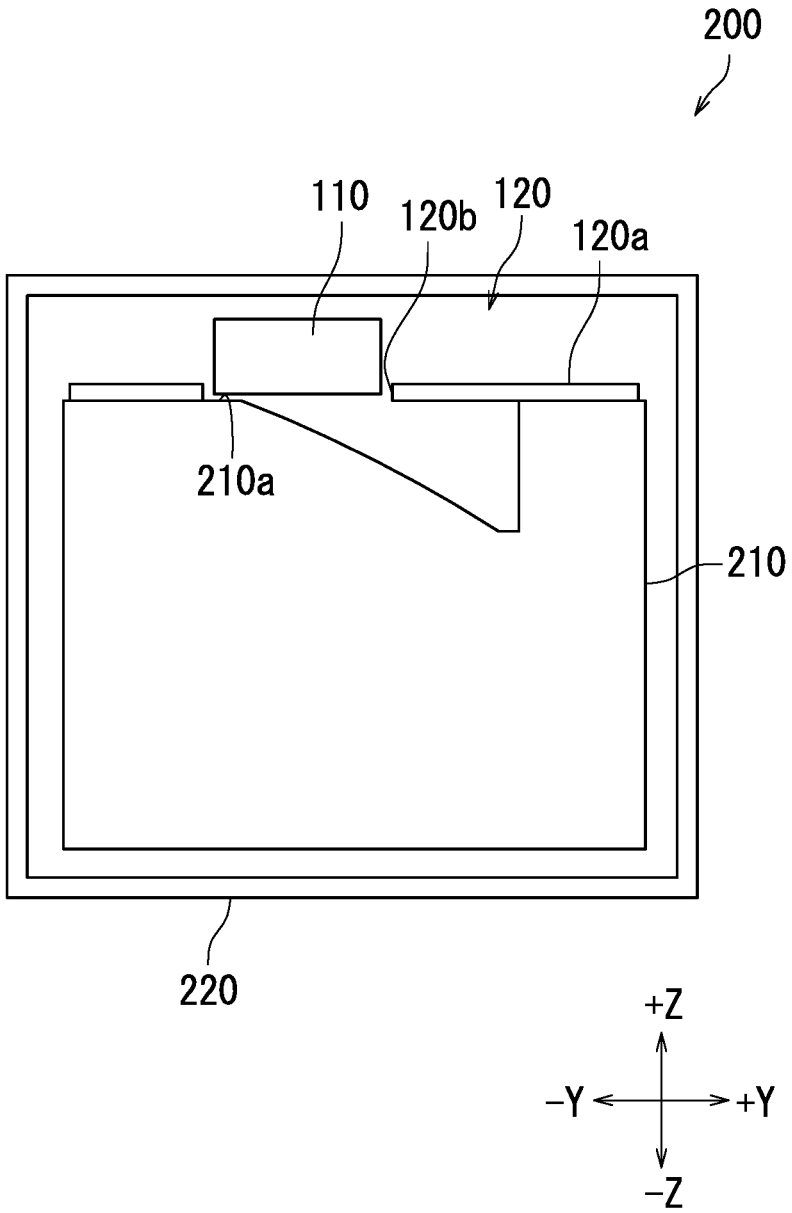
FIG. 3 is a side view of the package including the cushion structure according to the embodiment.

FIG. 3 is a side view of the package 200 including the cushion structure 100 according to the present embodiment. The packing 220 accommodates the cushion structure 100 and the image forming apparatus 210. The cushion structure 100 is disposed above the image forming apparatus 210.

The cushioning member 120 is disposed on the top surface of the image forming apparatus 210. The top surface of the image forming apparatus 210 supports the cushioning member 120. The cushioning member 120 surrounds the waste toner box 110 and restricts the position of the waste toner box 110. The waste toner box 110 is disposed in the restriction section 120*b* of the cushioning member 120. As described above, the restriction section 120*b* restricts movement of the waste toner box 110 supported on the top surface of the image forming apparatus 210 by inserting the waste toner box 110 into the opening.

The cushioning member 120 cushions not only shock on the top surface of the image forming apparatus 210 but also shock on the waste toner box 110. Furthermore, since the waste toner box 110 is made of a material that is softer than the material of the housing of the image forming apparatus 210, the waste toner box 110 itself cushions shock on the top surface of the image forming apparatus 210.

In the description given above with reference to FIGS. 1 and 2, the cushioning member 120 is hollow, and the outer surfaces of the cushioning member 120 are substantially flat.

However, the present disclosure is not limited as such. The cushioning member 120 may have a projection or a recess for engagement with other cushioning.

Figure 4:
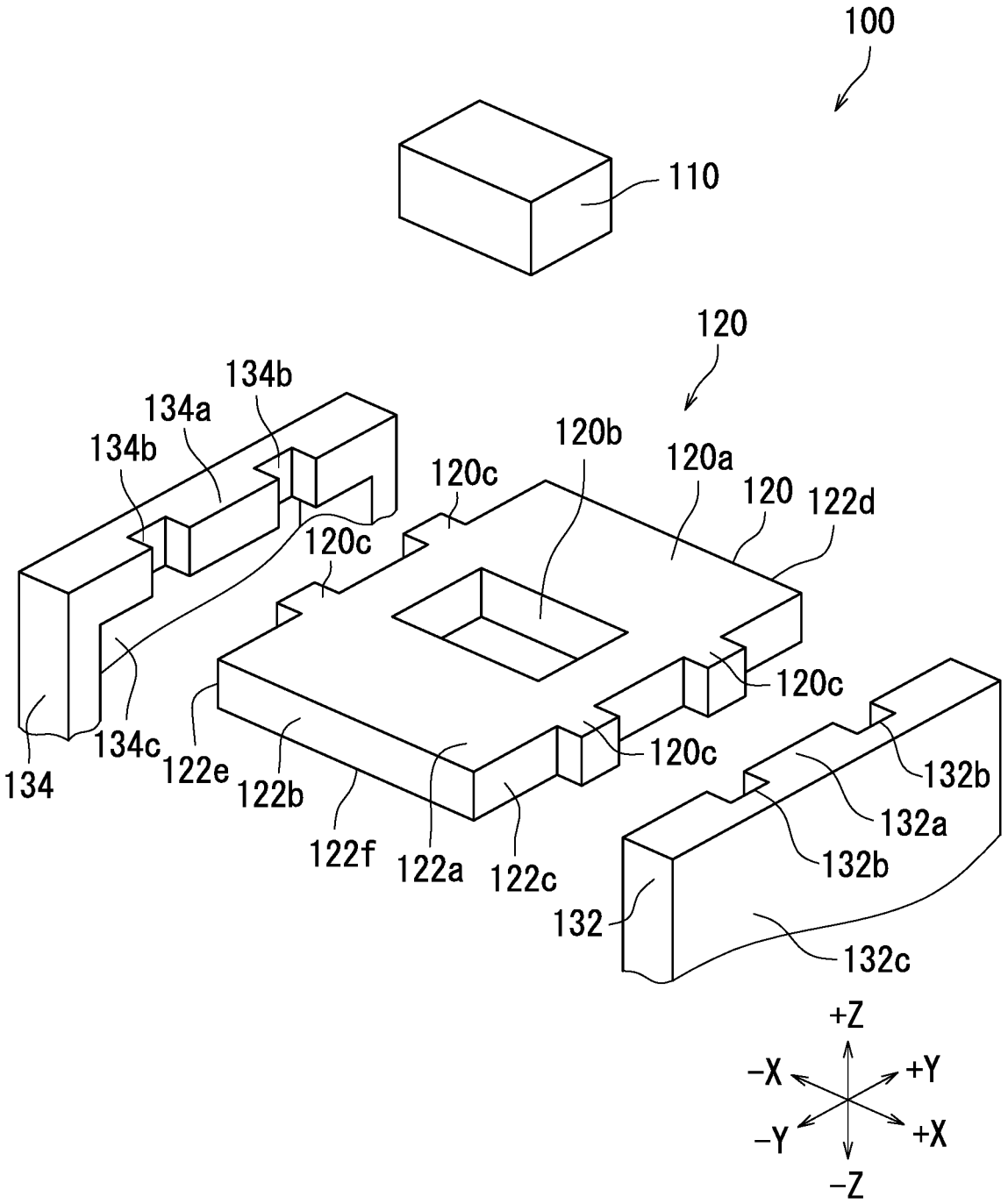
FIG. 4 is an exploded perspective view of another cushion structure according to the embodiment.

FIG. 4 is an exploded perspective view of another cushion structure 100 according to the present embodiment. The cushion structure 100 according to the present embodiment further includes a first protector 132 and a second protector 134 in addition to the waste toner box 110 and the cushioning member 120.

The first protector 132 and the second protector 134 are made of a material that is softer than the material of the housing of the image forming apparatus 210 (FIGS. 1 and 3). For example, the first protector 132 and the second protector 134 are made of cardboard. Alternatively, the first protector 132 and the second protector 134 may be made of foamed plastic. For example, the first protector 132 and the second protector 134 may be made of foamed polystyrene. Alternatively, the first protector 132 and the second protector 134 may be molded pulp.

The cushioning member 120 has extensions 120*c* in addition to the main body 120*a* and the restriction section 120*b*. The restriction section 120*b* is located approximately in the center of the cushioning member 120, and the main body 120*a* surrounds the restriction section 120*b*. In the present example, the cushioning member 120 has a through hole in the center thereof, and the through hole serves as the restriction section 120*b*.

The main body 120*a* has an upper face 122*a*, four side faces 122*b*, 122*c*, 122*d*, and 122*e*, and a lower face 122*f*. The upper face 122*a* of the cushioning member 120 faces in a +Z direction, and the lower face 122*f* of the cushioning member 120 faces in a −Z direction. The side faces 122*b*, 122*c*, 122*d*, and 122*e* of the cushioning member 120 respectively face a −Y direction, a +X direction, a +Y direction, and a −X direction.

The side faces 122*b* and 122*d* extend in the X direction, and the side faces 122*c* and 122*e* extend in the Y direction. The side faces 122*c* and 122*e* have the extensions 120*c*. Two extensions 120*c* extend in the +X direction from the side face 122*c*, and two extensions 120*c* extend in the −X direction from the side face 122*e*. A thickness (Z-direction length) of the extensions 120*c* is substantially equal to the thickness (Z-direction length) of the main body 120*a*.

The first protector 132 is located opposite to the side face 122*c* of the cushioning member 120. A height (Z-direction length) of the first protector 132 is substantially equal to a height (Z-direction length) of the inside of the packing 220 (see FIG. 1).

The first protector 132 has a projection 132*a*, recesses 132*b*, and a main body 132*c*. The main body 132*c* has a rectangular shape having substantially the same size as a side face of the inside of the packing 220. The projection 132*a* projects in the −X direction from the main body 132*c*, and the recesses 132*b* are recessed relative to the projection 132*a*. The first protector 132 in the present example has one projection 132*a* and two recesses 132*b* recessed in the +X direction.

The shape and the size of the recesses 132*b* of the first protector 132 correspond to the extensions 120*c* on the side face 122*c* of the cushioning member 120. The extensions 120*c* on the side face 122*c* are fitted into the respective recesses 132*b* of the first protector 132. The first protector 132 may be in contact with the cushioning member 120 or out of contact with the cushioning member 120 in an arrangement in which the first protector 132 is located opposite to the side face 122*c* of the cushioning member 120.

The second protector 134 is located opposite to the side face 122*e* of the cushioning member 120. A height (Z-direction length) of the second protector 134 is substantially equal to the height (Z-direction length) of the inside of the packing 220 (see FIG. 1).

The second protector 134 has a projection 134*a*, recesses 134*b*, and a main body 134*c*. The main body 134*c* has a rectangular shape having substantially the same size as a side face of the inside of the packing 220. The projection 134*a* projects in the +X direction from the main body 134*c* and the recesses 134*b* are recessed relative to the projection 134*a*. The second protector 134 in the present example has one projection 134*a* and two recesses 134*b* recessed in the −X direction.

The shape and the size of the recesses 134*b* of the second protector 134 correspond to the extensions 120*c* on the side face 122*e* of the cushioning member 120. The extensions 120*c* on the side face 122*e* are fitted into the respective recesses 134*b* of the second protector 134. The second protector 134 may be in contact with the cushioning member 120 or out of contact with the cushioning member 120 in an arrangement in which the second protector 134 is located opposite to the side face 122*e* of the cushioning member 120.

In the cushion structure 100 illustrated in FIG. 4, the first protector 132 and the second protector 134 are arranged beside the cushioning member 120. This arrangement allows the cushioning member 120 to engage with the first protector 132 and the second protector 134. It is therefore possible to restrict the position of the cushioning member 120 and sufficiently protect the cushioning member 120 using the first protector 132 and the second protector 134 even when the cushioning member 120 is impacted relatively strongly.

In the description given above with reference to FIG. 4, the cushioning member 120 has a constant thickness (Z-direction length). However, the present disclosure is not limited as such. The thickness of the cushioning member 120 may vary according to location.

Figure 5:
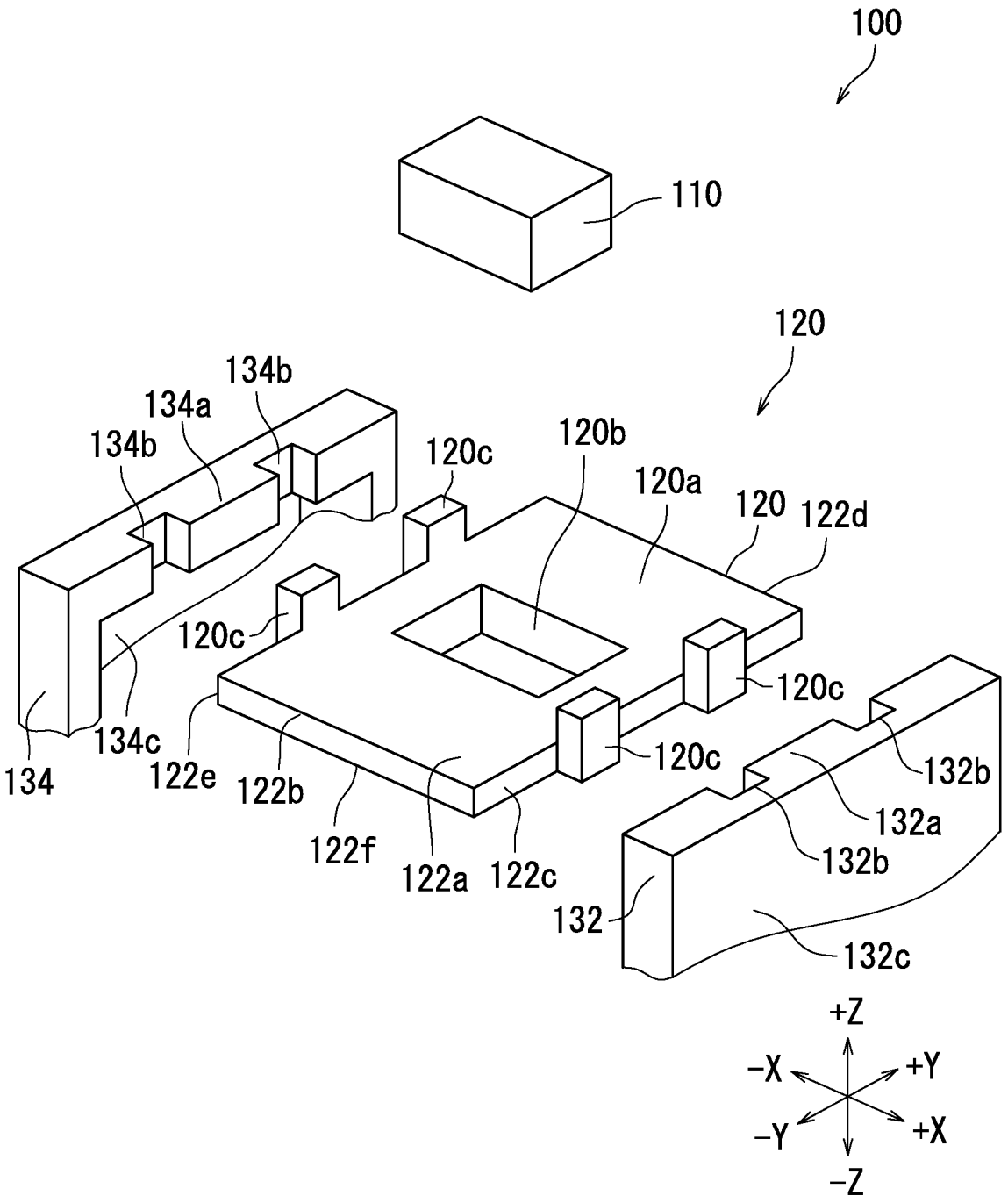
FIG. 5 is an exploded perspective view of another cushion structure according to the embodiment.

FIG. 5 is an exploded perspective view of another cushion structure 100 according to the present embodiment. The cushion structure 100 illustrated in FIG. 5 has the same configuration as the cushion structure 100 described above with reference to FIG. 4 except that the thickness (Z-direction length) of the extensions 120*c* of the cushioning member 120, the thickness (Z-direction length) of the first protector 132, and the thickness (Z-direction length) of the second protector 134 are greater than the height (Z-direction length) of the main body 120*a* of the cushioning member 120. Therefore, redundant description is omitted in order to avoid repetition.

The thickness (Z-direction length) of the extensions 120*c* is greater than the thickness (Z-direction length) of the main body 120*a*. The thickness (Z-direction length) of the projection 132*a* in an upper portion of the first protector 132 is substantially equal to the thickness (Z-direction length) of the extensions 120*c* and is greater than the thickness (Z-direction length) of the main body 120*a*. Likewise, the thickness (Z-direction length) of the projection 134*a* in an upper portion of the second protector 134 is substantially equal to the thickness (Z-direction length) of the extensions 120*c* and is greater than the thickness (Z-direction length) of the main body 120*a*.

In the cushion structure 100 illustrated in FIG. 5, engagement between the cushioning member 120 and the first protector 132 is achieved through the relatively thick extensions 120*c* and the recesses 132*b* of the first protector 132. It is therefore possible to restrict the position of the cushioning member 120 and sufficiently protect the cushioning member 120 using the first protector 132 even when the cushioning member 120 is impacted relatively strongly. Likewise, engagement between the cushioning member 120 and the second protector 134 is achieved through the relatively thick extensions 120*c* and the recesses 134*b* of the second protector 134. It is therefore possible to restrict the position of the cushioning member 120 and sufficiently protect the cushioning member 120 using the second protector 134 even when the cushioning member 120 is impacted relatively strongly.

FIGS. 1 to 5 schematically illustrate the waste toner box 110 as a rectangular parallelepiped. However, the present disclosure is not limited as such. The waste toner box 110 may have a shape other than a rectangular parallelepiped shape.

Figure 6A:
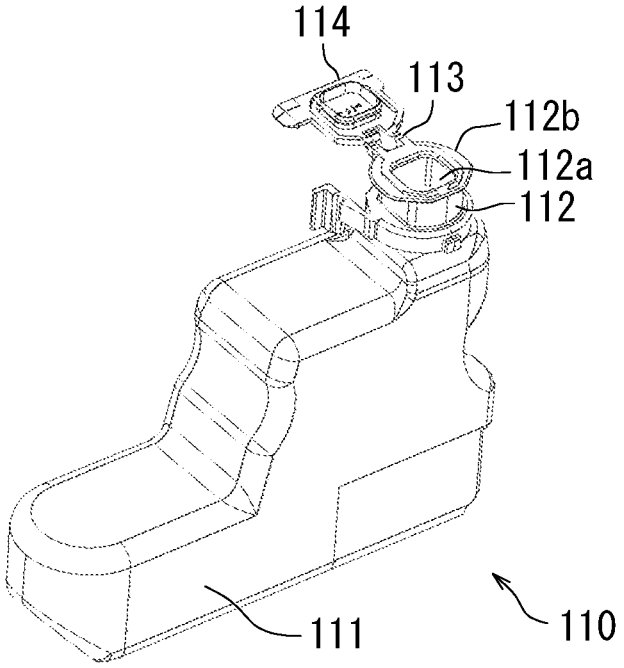
FIGS. 6A and 6B are each a perspective view of a waste toner box in another cushion structure according to the embodiment.
Figure 6B:
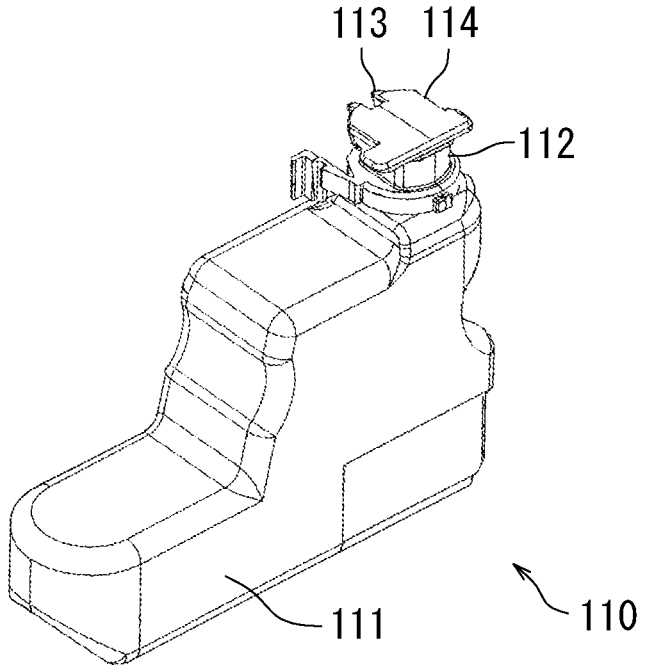

FIGS. 6A and 6B are each a perspective view of a waste toner box 110 in another cushion structure 100 according to the present embodiment. FIG. 6A is a perspective view of the waste toner box 110 with a waste toner inlet thereof open. FIG. 6B is a perspective view of the waste toner box 110 with the waste toner inlet hermetically closed. The waste toner box 110 is to be mounted in a space inside the housing of the image forming apparatus 210.

The waste toner box 110 in the present example is hollow. The waste toner box 110 has a shoe-like outer shape. The waste toner box 110 is made of a resin material such as polypropylene. For example, the waste toner box 110 is formed using a metallic mold.

The waste toner box 110 collects toner used in the image forming apparatus 210 (FIGS. 1 and 3). When the waste toner box 110 is in place in the housing of the image forming apparatus 210, the used toner to be collected is conveyed to the waste toner box 110 by a used toner conveying device, not shown. Once the waste toner box 110 is filled with the used toner, a user detaches the waste toner box 110 from the housing of the image forming apparatus 210 and replaces the detached waste toner box 110 with an empty waste toner box 110.

The waste toner box 110 includes a tank 111, a receiving section 112, a hinge 113, and a cap 114. The tank 111 accommodates the toner used in the inside of the image forming apparatus 210 (FIGS. 1 and 3).

The receiving section 112 has a cylindrical shape protruding upward from a rear end portion of the tank 111. The receiving section 112 includes an inlet (intake) 112*a* and a collar 112*b*. The inlet 112*a* is an opening formed in an upper end portion of the receiving section 112. The used toner to be collected flows into the tank 111 through the inlet 112*a*. The collar 112*b* surrounds the circumference of the inlet 112*a* and protrudes outward from the inlet 112*a*.

The cap 114 engages with the receiving section 112 to hermetically close the inlet 112*a*. The hinge 113 connects the receiving section 112 with the cap 114. The hinge 113 enables the cap 114 to pivot with respect to the tank 111. Through pivoting, the cap 114 can change its state between a first state (FIG. 6A) in which the cap 114 is separate from the inlet 112*a* and a second state (FIG. 6B) in which the cap 114 hermetically closes the inlet 112*a*.

The waste toner box 110 illustrated in FIGS. 6A and 6B can be favorably fixed using cushioning.

Figure 7A:
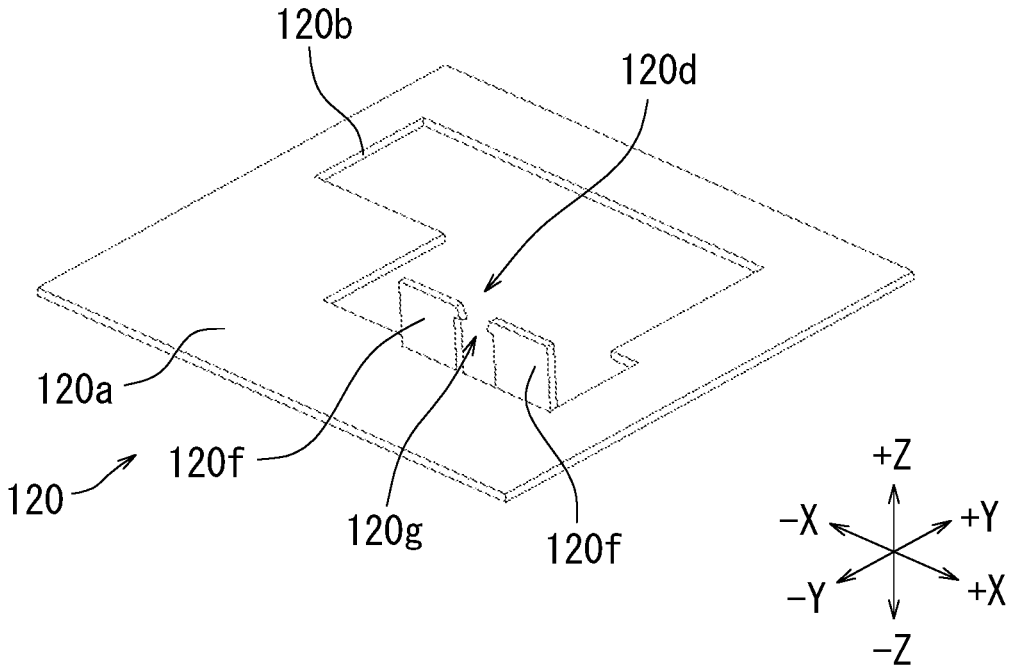
FIG. 7A is a perspective view of a cushioning member in the cushion structure according to the embodiment.
Figure 7B:
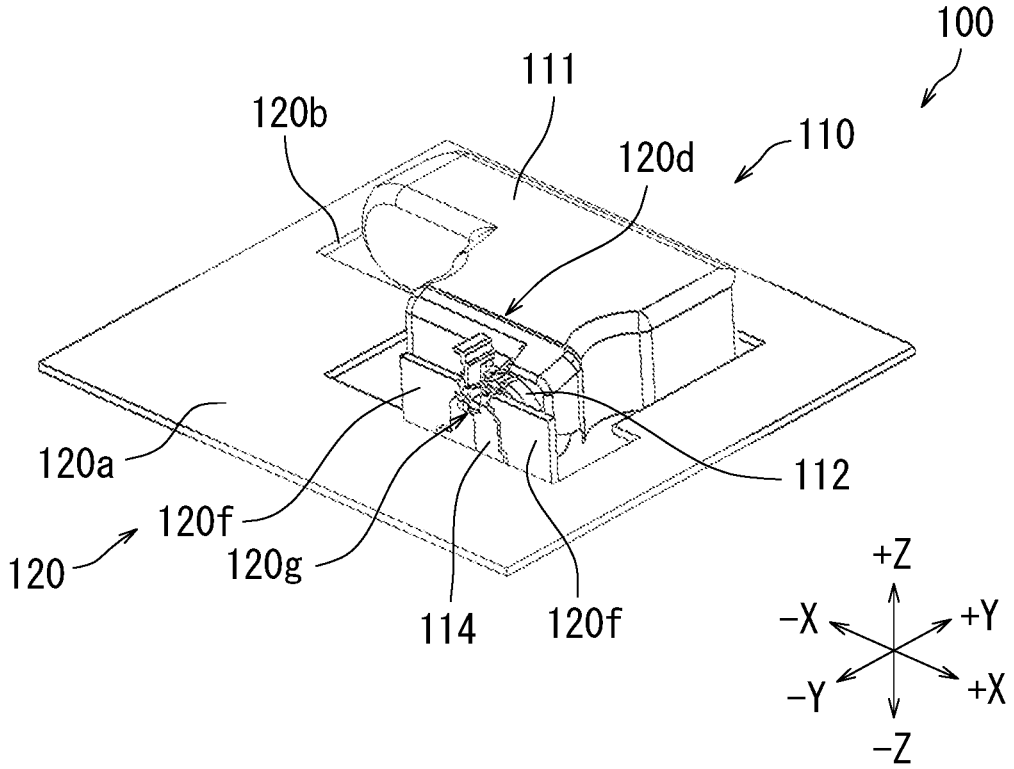
FIG. 7B is a perspective view of the cushion structure with the waste toner box attached to the cushioning member illustrated in FIG. 7A.

The following describes the cushion structure 100 with the waste toner box 110 fixed to the cushioning member 120 with reference to FIGS. 7A and 7B. FIG. 7A is a perspective view of the cushioning member 120 in the cushion structure 100 according to the present embodiment. FIG. 7B is a perspective view of the cushion structure 100 according to the present embodiment including the cushioning member 120 illustrated in FIG. 7A.

As illustrated in FIG. 7A, the cushioning member 120 includes a fixing section 120*d* in addition to the main body 120*a* and the restriction section 120*b*. The restriction section 120*b* is located approximately in the center of the cushioning member 120. The main body 120*a* has a substantially constant thickness and surrounds the restriction section 120*b*. The main body 120*a* extends in the X and Y directions.

The fixing section 120*d* extends in a direction intersecting with the main body 120*a*. For example, the fixing section 120*d* extends in a direction (Z direction) orthogonal to the main body 120*a*. The fixing section 120*d* in the present example is erected from the main body 120*a*.

The fixing section 120*d* corresponds to a portion of the restriction section 120*b*. A −Y-direction end of the fixing section 120*d* connects to the main body 120*a*. A +X-direction end and a −X-direction end of the fixing section 120*d* do not connect to the main body 120*a*.

The fixing section 120*d* includes a fixing piece 120*f* and a notch portion 120*g*. The fixing piece 120*f* stands on an edge of the restriction section 120*b*. The notch portion 120*g* is provided on the fixing piece 120*f* so as to hold a part of the waste toner box 110. The notch portion 120*g* supports the part of the waste toner box 110. The fixing section 120*d* has a through hole penetrating the fixing section 120*d* in the Y direction. The through hole of the fixing section 120*d* connects to the notch portion 120*g* in an upper portion of the fixing section 120*d*. In the fixing section 120*d*, an X-direction length of a side face of the notch portion 120*g* is shorter than an X-direction length of a side face of the through hole. The fixing section 120*d* further has protrusions at the notch portion 120*g*.

The fixing section 120*d* of the cushioning member 120 fixes the waste toner box 110 as illustrated in FIG. 7B. The waste toner box 110 is moved in the −Z direction toward the fixing section 120*d* from above and inserted in the through hole through the notch portion 120*g* of the fixing section 120*d*. The waste toner box 110 is fixed to the fixing section 120*d* through the receiving section 112 and the cap 114 of the waste toner box 110 holding the fixing section 120*d* therebetween. In the present example, the size of the through hole of the fixing section 120*d* is substantially the same as the size of the outer shape of the inlet 112*a* (FIG. 6A) in the receiving section 112 of the waste toner box 110.

Since the fixing section 120*d* of the cushioning member 120 fixes the waste toner box 110, the cushioning member 120 cushions not only shock on the top surface of the image forming apparatus 210 (FIGS. 1 and 3) but also shock on the waste toner box 110. Furthermore, since the waste toner box 110 is made of a material that is softer than the material of the housing of the image forming apparatus 210, the waste toner box 110 itself cushions shock on the top surface of the image forming apparatus 210.

In the description given above with reference to FIGS. 7A and 7B, the fixing section 120*d* connects to the main body 120*a* in the cushioning member 120, and the fixing section 120*d* is erected directly from the main body 120*a*. However, the present disclosure is not limited as such. The fixing section 120*d* may be erected from the main body 120*a* with a connection section therebetween.

Figure 8A:
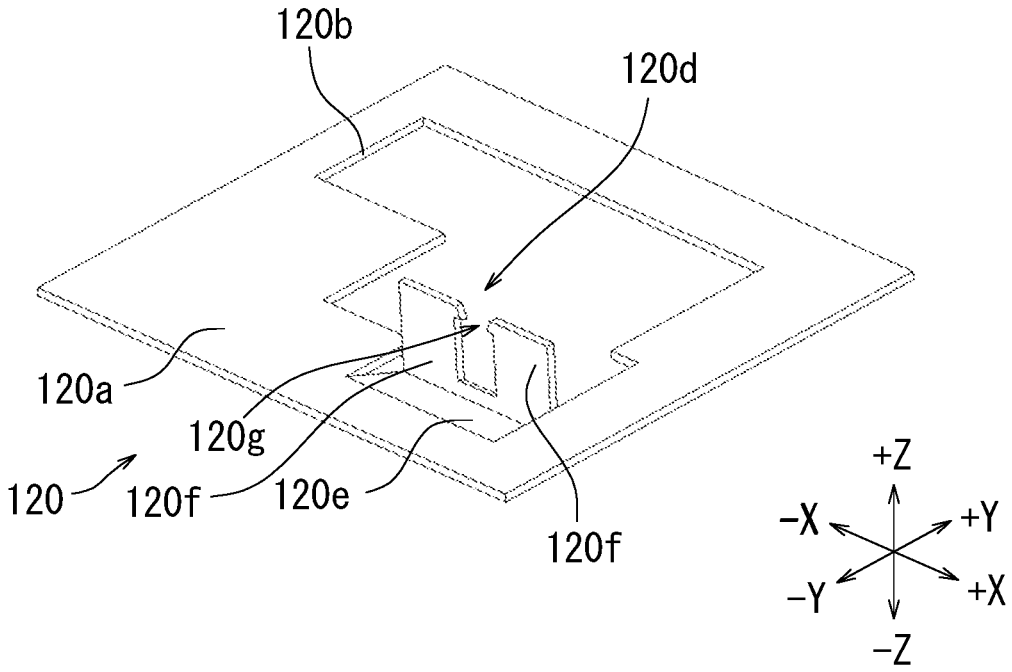
FIG. 8A is a perspective view of the cushioning member in another cushion structure according to the embodiment.
Figure 8B:
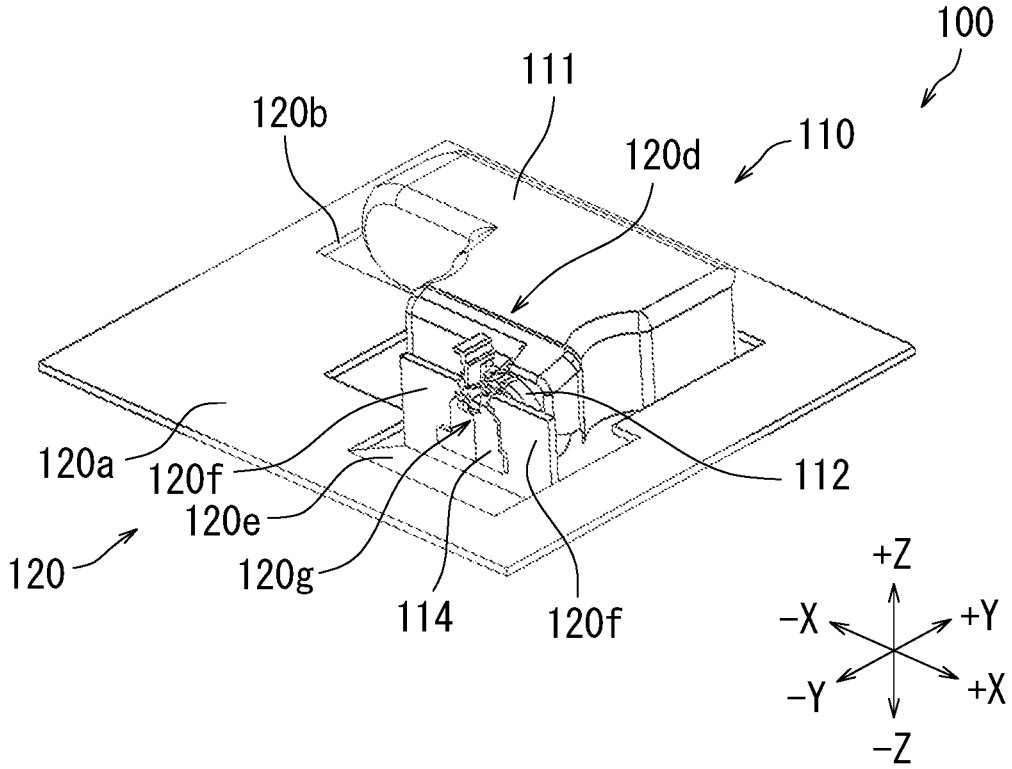
FIG. 8B is a perspective view of the cushion structure with the waste toner box attached to the cushioning member illustrated in FIG. 8A.

The following describes another cushion structure 100 with the waste toner box 110 fixed by a cushioning member 120 with reference to FIGS. 8A and 8B. FIG. 8A is a perspective view of the cushioning member 120 in the cushion structure 100 according to the present embodiment. FIG. 8B is a perspective view of the cushion structure 100 according to the present embodiment including the cushioning member 120 illustrated in FIG. 8A.

As illustrated in FIG.8A, the cushioning member 120 includes the main body 120*a*, the restriction section 120*b*, the fixing section 120*d*, and a connection section 120*e*. The restriction section 120*b* is located approximately in the center of the cushioning member 120. The main body 120*a* has a substantially constant thickness and surrounds the restriction section 120*b*. The main body 120*a* extends in the X and Y directions.

The connection section 120*e* connects the main body 120*a* with the fixing section 120*d*. A −Y-direction end of the connection section 120*e* connects to the main body 120*a*, and a +Y-direction end of the connection section 120*e* connects to the fixing section 120*d*. A +X-direction end and a −X-direction end of the connection section 120*e* do not connect to the main body 120*a*. The connection section 120*e* is pivotable in the +Z direction or the −Z direction about the −Y-direction end thereof, which connects to the main body 120*a*.

The connection section 120*e* is inclined in the −Z direction relative to the main body 120*a*, and the fixing section 120*d* is erected in the +Z direction from the connection section 120*e*. Accordingly, a border between the fixing section 120*d* and the connection section 120*e* is a valley fold relative to an upper surface (+Z-direction surface) of the main body 120*a*.

The fixing section 120*d* extends in a direction intersecting with the main body 120*a*. For example, the fixing section 120*d* extends in a direction (Z direction) orthogonal to the main body 120*a*. The fixing section 120*d* in the present example is erected from the main body 120*a* with the connection section 120*e* therebetween. The fixing section 120*d* has a through hole penetrating the fixing section 120*d* in the Y direction. The through hole of the fixing section 120*d* connects to the notch portion 120*g* in an upper portion of the fixing section 120*d*.

The fixing section 120*d* of the cushioning member 120 fixes the waste toner box 110 as illustrated in FIG. 8B. The waste toner box 110 is moved in the −Z direction toward the fixing section 120*d* from above and inserted in the through hole through the notch portion 120*g* of the fixing section 120*d*. The waste toner box 110 is fixed to the fixing section 120*d* through the receiving section 112 and the cap 114 of the waste toner box 110 holding the fixing section 120*d* therebetween. Since the fixing section 120*d* of the cushioning member 120 fixes the waste toner box 110, the cushioning member 120 cushions not only shock on the top surface of the image forming apparatus 210 (FIGS. 1 and 3) but also shock on the waste toner box 110. Furthermore, since the waste toner box 110 is made of a material that is softer than the material of the housing of the image forming apparatus 210, the waste toner box 110 itself cushions shock on the top surface of the image forming apparatus 210. Furthermore, the connection section 120*e* connecting the main body 120*a* with the fixing section 120*d* in the cushioning member 120 prevents shock from being transferred to the cushioning member 120 even if the waste toner box 110 is impacted relatively strongly.

An embodiment of the present disclosure has been described above with reference to the drawings (FIGS. 1 to 8B). However, the present disclosure is not limited to the above embodiment and may be implemented in various different forms that do not deviate from the essence of the present disclosure. Also, a plurality of elements of configuration in a plurality of embodiments can be combined as appropriate to form various configurations. For example, some of the elements of configuration included in the embodiments may be omitted. The drawings schematically illustrate elements of configuration in order to facilitate understanding, and properties of the elements of configuration illustrated in the drawings, such as number thereof, may differ from actual properties thereof in order to facilitate preparation of the drawings. The elements of configuration in the above embodiment are merely examples, not particularly limited, and may be variously altered without substantially deviating from the effects of the present disclosure.

What is claimed is:

1. A cushion structure configured to be accommodated in packing together with an image forming apparatus and a waste toner box, the cushion structure comprising:

a cushioning member configured to surround the waste toner box and restrict a position of the waste toner box, wherein the cushioning member includes a planar main body, a restriction section in which the waste toner box is disposed, a fixing section configured to fix the waste toner box, and a connection section configured to connect the main body with the fixing section, the restriction section is formed as a through hole that is an opening located approximately in a center of the main body, the restriction section restricts movement of the waste toner box by inserting the waste toner box into the opening, the fixing section extends in a direction intersecting with the main body, a first end of the connection section connects to the main body, a second end of the connection section connects to the fixing section, the connection section is pivotable about the first end, the cushioning member is to be disposed on a top surface of the image forming apparatus, the restriction section restricts movement of the waste toner box supported on the top surface, and the waste toner box cushions shock on the top surface of the image forming apparatus.

2. The cushion structure according to claim 1, wherein the waste toner box is made of polypropylene or polyethylene.

3. The cushion structure according to claim 1, wherein the cushioning member is made of cardboard.

4. The cushion structure according to claim 1, wherein the fixing section includes a notch portion to hold and support a part of the waste toner box.

* * * * *